US008624096B2

(12) United States Patent
Lai

(10) Patent No.: US 8,624,096 B2
(45) Date of Patent: Jan. 7, 2014

(54) PLECTRUM SLEEVE

(76) Inventor: Reed Lai, Miaoli (TW)

( * ) Notice: Subject to any disclaimer, the term of this patent is extended or adjusted under 35 U.S.C. 154(b) by 0 days.

(21) Appl. No.: 13/452,927

(22) Filed: Apr. 22, 2012

(65) Prior Publication Data

US 2013/0276614 A1 Oct. 24, 2013

(51) Int. Cl.
*G10D 3/16* (2006.01)

(52) U.S. Cl.
USPC ..... 84/322

(58) Field of Classification Search
USPC ..... 84/315–317, 320–322
See application file for complete search history.

(56) References Cited

U.S. PATENT DOCUMENTS 3,648,558 A * 3/1972 Chenette ..... 84/322

* cited by examiner

*Primary Examiner* — Kimberly Lockett

(57) ABSTRACT

A plectrum sleeve has a sleeve body with an extending sheet. The sleeve body has a longitudinal open on an upper side thereof. The extending sheet is slantingly extending from an edge of a bottom side of the sleeve body. A plectrum piece is extending from an end of the extending sheet. The sleeve body is slid to a distal end of a finger with the extending sheet attached to the tip of the finger and the plectrum piece located in the front of the tip of the finger like an extension of the nail. The plectrum piece plunks a string of an instrument by bending or stretching the finger, the force back to the plectrum sleeve from the string will be strongly and steadily supported by the finger. A real and direct counterforce will be given to the finger and the user for better experience of plunking.

2 Claims, 4 Drawing Sheets

PLECTRUM SLEEVE

FIELD OF THE INVENTION

The present invention relates to plectrum, and particular to a plectrum sleeve which can be stably slid to fingers with strong support and provide a direct and instant feed back during plunking a stringed instrument.

DESCRIPTION OF THE PRIOR ART

Plectrum is a common tool for plunking stringed instruments. Former plectrum is a small flat piece held by hand, and it is obviously that the player can only use one such plectrum or so-called pick for a time. A spectrum capable of being slid to fingers of a player allows more possibility for flexible plunking. Referring to FIGS. 1 and 2, a prior plectrum is slid to a distal end of a finger. An extending sheet of the plectrum protruding from the location of the nail of the finger serves to plunk a string of an instrument. For the extending sheet just like an extension of the nail, the user can plunk the string habitually. However, during a plunk by bending the finger, a supporting point B illustrated in FIG. 2 around the muscle of the distal end is relatively weak so that a displacement of the plectrum will take place. Such displacement could damp the force applied to the string and also a counterforce from the string to the finger so that the precision and temple of the playing could be impacted.

SUMMARY OF THE PRESENT INVENTION

Accordingly, the primary object of the present invention is to provide a plectrum sleeve slid to fingers with better support so that the user can plunk precisely.

To achieve above objects, the present invention mainly includes a sleeve body with an extending sheet. The sleeve body has a longitudinal open on an upper side thereof. The extending sheet is slantingly extending from an edge of a bottom side of the sleeve body. A plectrum piece is extending from an end of the extending sheet. The sleeve body is slid to a distal end of a finger with the extending sheet attached to the tip of the finger and the plectrum piece located in the front of the tip of the finger like an extension of the nail. The plectrum piece plunks a string of an instrument by bending or stretching the finger, the force back to the plectrum sleeve from the string will be strongly and steadily supported by the nail, finger tip, and the knuckle. A real and direct counterforce will be given to the finger and the user for better experience of plunking.

The various objects and advantages of the present invention will be more readily understood from the following detailed description when read in conjunction with the appended drawing.

DETAILED DESCRIPTION OF THE IVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
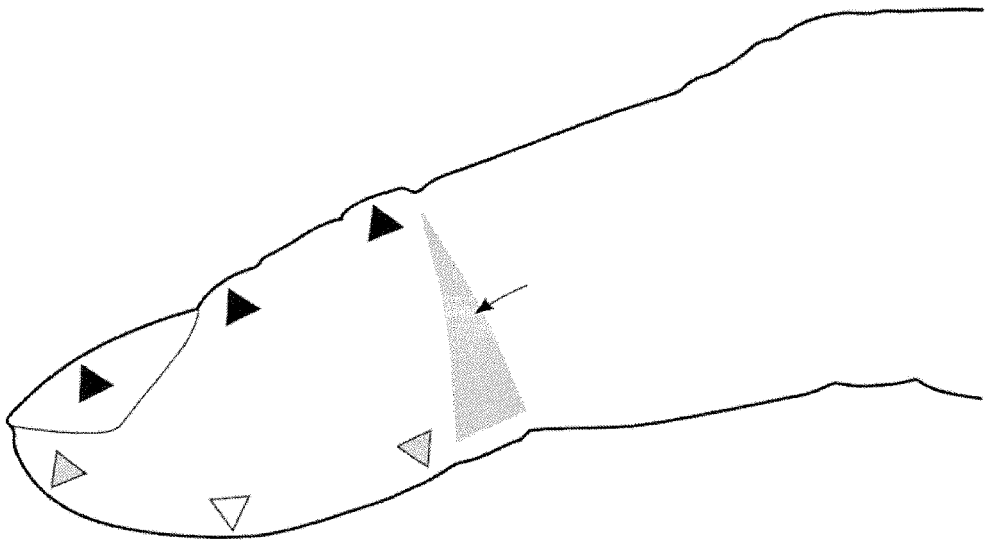
FIG. 1 is schematic view showing physical condition of a human finger.
Figure 2:
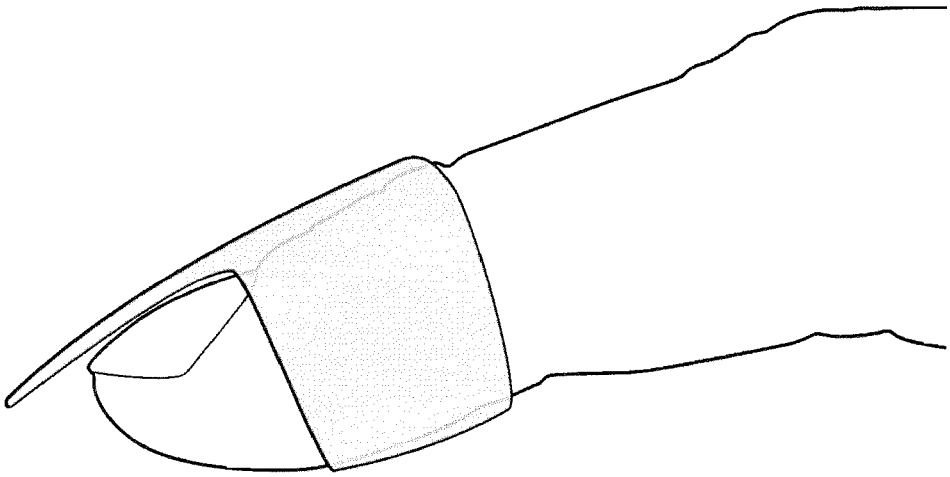
FIG. 2 is a schematic view showing a prior plectrum.
Figure 3:
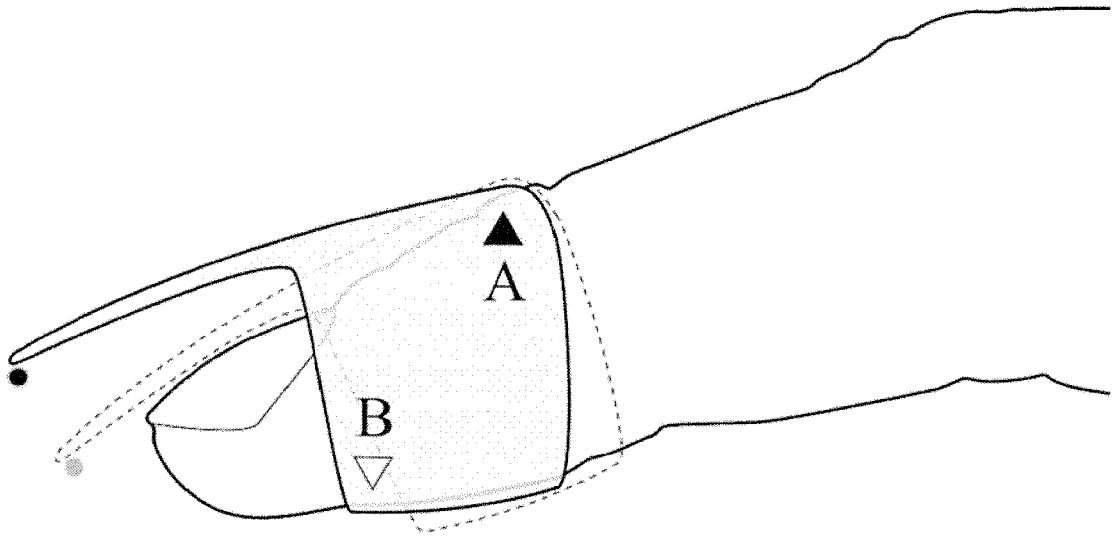
FIG. 3 is a schematic view showing the operation of the prior plectrum.

Referring to FIG. 1, a human finger is illustrated. Points A around the nail and the knuckle indicate physically strong points of the finger. A strong support can be provided through those locations. Points B around the finger tip and muscle near the knuckle can provide moderate support, while the point C around soft muscle is relatively a weak point for supporting. The deformation of the supporting point equals to the displacement of the plectrum plunking to a string which could impact the temple and precision of playing.

Figure 4:
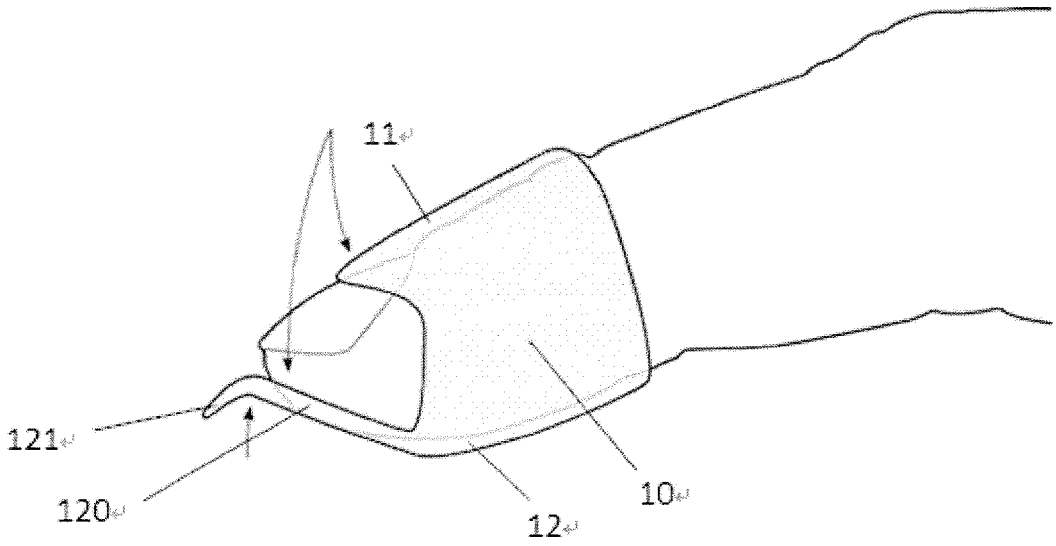
FIG. 4 is a schematic view showing a preferable embodiment of a plectrum sleeve of the present invention.

Referring to FIG. 4, a preferable embodiment of a plectrum sleeve according to the present invention is illustrated. The plectrum sleeve of the present invention includes:

A sleeve body 10 has a ring structure having an upper side 11 and a bottom side 12.

An extending sheet 120 is slantingly extending from an edge of the bottom side 12 towards the upper side 11 of the sleeve body 10, and A plectrum piece 121 roughly parallel to the upper side 11 extending from an end of the extending sheet 120;

The sleeve body 10 can be tightly slid to a distal end of a finger before the first knuckle of the finger with the upper side 11 attached to the nail so that the extending sheet 120 is attached to the tip of the finger and the plectrum piece 121 is located in the front of the tip of the finger like an extension of the nail.

Figure 5:
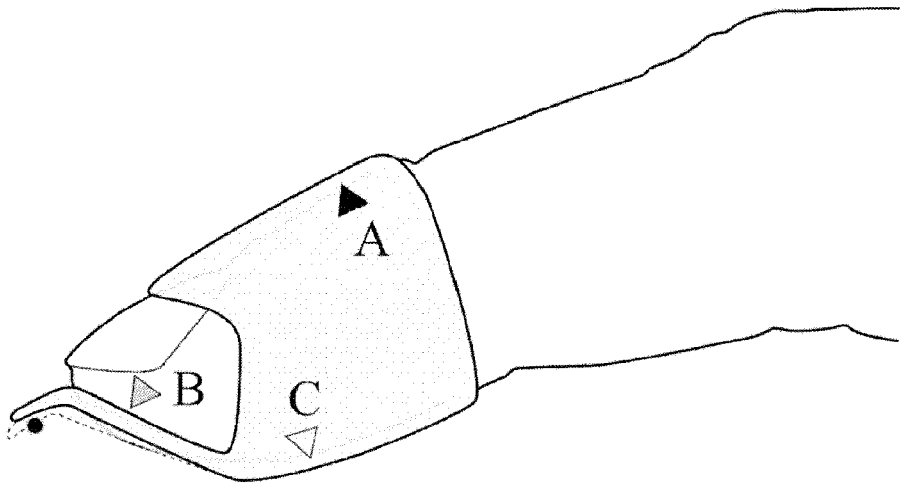
FIG. 5 is a schematic view showing the operation of the present invention.
Figure 6:
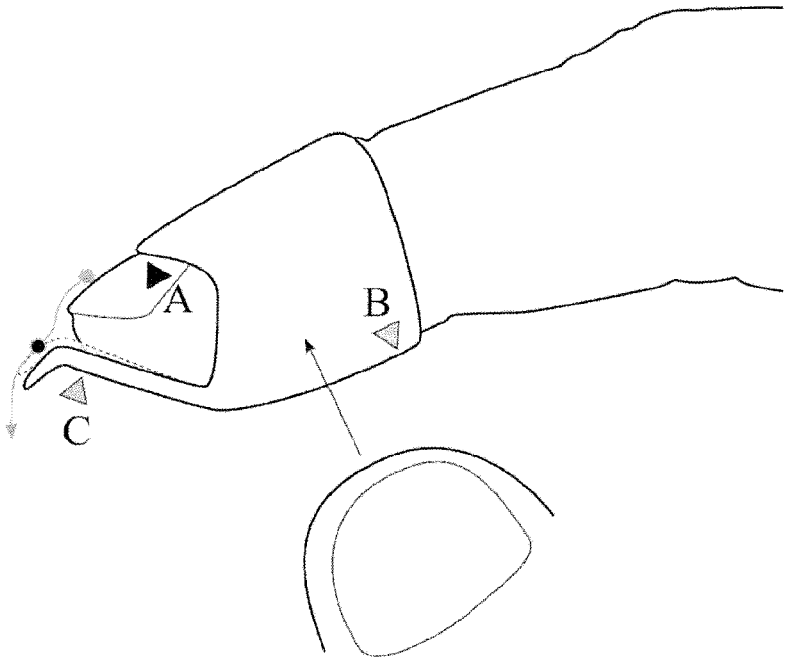
FIG. 6 is a schematic view showing the operation of the present invention.

Referring to FIGS. 5 and 6, the operations of the plectrum sleeve are illustrated. During a plunk by swinging or bending the finger, the force applied to the plectrum sleeve from the string approaching from the bottom side is mainly supported by points A and B which provide strong and steady support. The plectrum sleeve won't move a lot so that a real and direct counterforce is given to the finger and the user. During a plunk by stretching the finger as illustrated in FIG. 6, the plectrum sleeve pushing the string closed to the upper side 11 of the plectrum sleeve is supported by points A, B, and C which also provide a strong and steady support. The plectrum sleeve won't move a lot so that a real and direct counterforce can be also given to the finger and the user. In addition, by pressing the bottom side 12 of the plectrum sleeve with the thumb the user can apply a stronger plunk like the way a prior plectrum or a pick dose.

Figure 7:
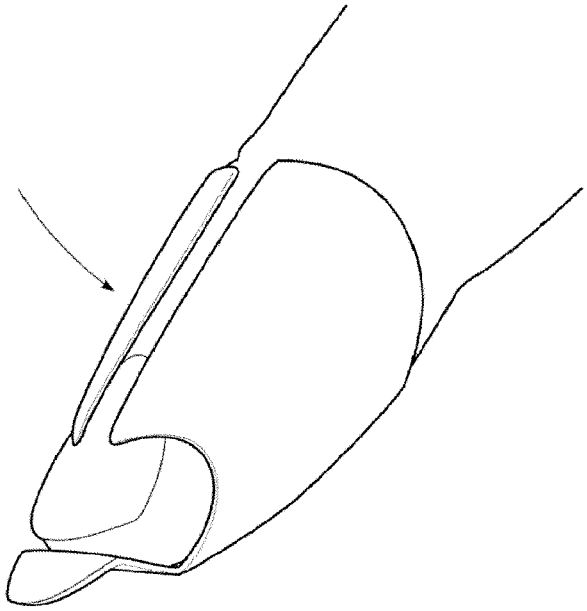
FIG. 7 is a schematic view showing another preferable embodiment of the present invention.

Referring to FIG. 7, another embodiment of the present invention is illustrated.

The plectrum sleeve has a sleeve body 10 having a ring like structure with an upper side 11 and a bottom side 12. The sleeve body 10 has a longitudinal axial open 110 on the upper side 11. An extending sheet 120 is slantingly extending from an edge of the bottom side 12 towards the upper side 11 of the sleeve body 10, and a plectrum piece 121 roughly parallel to the upper side 11 is extending from an end of the extending sheet 120. The sleeve body 10 can be tightly slid to a distal end of a finger before the first knuckle of the finger with the upper side 11 attached to the nail so that the extending sheet 120 is attached to the tip of the finger and the plectrum piece 121 is located in the front of the tip of the finger like an extension of the nail. Through the open 110, the plectrum sleeve becomes more elastically so that it can be perfectly fit on fingers of different sizes.

Figure 8:
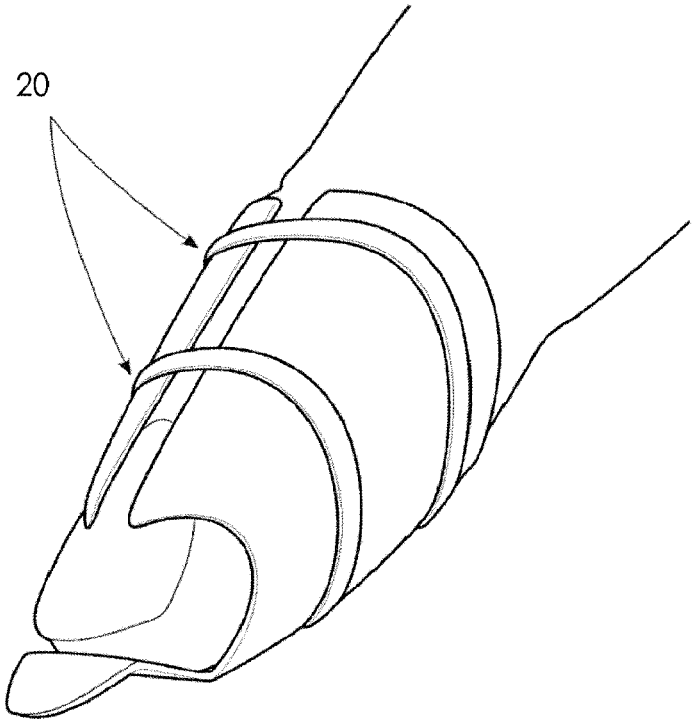
FIG. 8 is a schematic view showing a clamp unit of the present invention.

Referring to FIG. 8, it is illustrated that for enhancing, the clamping of the plectrum sleeve having the open 110, at least one elastic clamp unit 20 can be applied to the sleeve body 10 to tighten the sleeve body 10 to the finger as illustrated in FIG. 8.

The present invention is thus described, it will be obvious that the same may be varied in many ways. For example, the slot 11, 12 can be formed directly to the pillar; the pushing head 46 of the tightening unit 4 can be formed like a saddle capable of sitting across the water blocking sheet for better stability. Such variations are not to be regarded as a departure from the spirit and scope of the present invention, and all such modifications as would be obvious to one skilled in the art are intended to be included within the scope of the following claims.

What is claimed is:

1. A plectrum sleeve comprising:

a sleeve body sliding to a human's finger;

an extending sheet extending from an edge of an end of the sleeve body;

a plectrum piece extending from an end of the extending sheet;

wherein the sleeve body is slid to a finger with the extending sheet attached to a tip of the finger and the plectrum piece located in a front of a nail; and at least one clamp unit capable of clamping the sleeve body to tightly fix the plectrum sleeve to the finger.

2. The plectrum sleeve as claimed in claim 1, wherein the sleeve body has a longitudinal open on an upper side thereof.

* * * * *